US010561579B2

(12) United States Patent
Piering

(10) Patent No.: US 10,561,579 B2
(45) Date of Patent: Feb. 18, 2020

(54) MEDICAMENT CONTAINER AND DISPENSER

(71) Applicant: Sallie Piering, Midland, MI (US)

(72) Inventor: Sallie Piering, Midland, MI (US)

( * ) Notice: Subject to any disclaimer, the term of this patent is extended or adjusted under 35 U.S.C. 154(b) by 379 days.

(21) Appl. No.: 14/550,044

(22) Filed: Nov. 21, 2014

(65) Prior Publication Data

US 2015/0174005 A1 Jun. 25, 2015

Related U.S. Application Data

(60) Provisional application No. 61/915,557, filed on Dec. 13, 2013.

(51) Int. Cl.
*A61J 1/03* (2006.01)
*A45F 5/00* (2006.01)

(52) U.S. Cl.
CPC ..... *A61J 1/035* (2013.01); *A45F 5/00* (2013.01); *A45F 2005/008* (2013.01)

(58) Field of Classification Search
CPC .... A45F 5/00; A45F 5/008; A45F 5/02; A45F 2005/008; A45F 2005/006; A45F 2005/023; A45F 2200/05; A61J 1/035; A44C 25/004; A44C 9/0069
USPC ..... 206/216; 63/1.14, 1.15
See application file for complete search history.

(56) References Cited

U.S. PATENT DOCUMENTS 3,472,367 A * 10/1969 Hellstrom ..... B65D 75/32 206/469
2009/0108039 A1* 4/2009 Sherman ..... A45F 5/00 224/577
2011/0127306 A1* 6/2011 Haston ..... A45F 5/00 224/219
2013/0075437 A1* 3/2013 Zinnerman ..... A45C 1/04 224/587
2014/0110445 A1* 4/2014 Eisner ..... A44C 5/003 224/222
2014/0117060 A1* 5/2014 Colone ..... A44C 5/003 224/219

* cited by examiner

*Primary Examiner* — Anthony D Stashick
*Assistant Examiner* — James M Van Buskirk

(57) ABSTRACT

A medicament container comprising in combination, a support band and a hollow medicament retainer with a medicament blister pack. The device is a disposable (i.e. single use), inexpensive, pre-loaded, sealed, condition specific, wearable device such that it can be carried virtually anywhere that the user goes.

23 Claims, 7 Drawing Sheets

MEDICAMENT CONTAINER AND DISPENSER

BACKGROUND OF THE INVENTION

The use of bracelets, rings, and necklaces, for example, for hiding or carrying medicaments or poisons, or the like, has been known for centuries. The concept of having medicaments on a person for emergencies is also not a new idea, in that, there are many devices being sold today to hold medicaments that can be used for emergencies, for example, aspirin, used for potential heart attack victims or nitro tablets for heart problems.

The devices of this invention provide a single use, preloaded, sealed, condition specific, wearable device for carrying medicaments.

This application claims priority from U.S. Provisional Patent application Ser. No. 61/915,557, filed on Dec. 13, 2013.

THE INVENTION

What is therefore disclosed and claimed herein as the invention is a medicament, container comprising in combination, a support band and a hollow medicament retainer. The hollow medicament retainer is supported on the support band. The hollow medicament retainer has a top and an open bottom and the hollow in the hollow medicament retainer contains a blister pack having a bottom. The blister pack contains at least one solid medicament and the blister pack bottom has a breakable seal such that when the seal is broken, the solid medicament contained therein is dispensed.

DETAILED DESCRIPTION OF THE INVENTION

Figure 1:
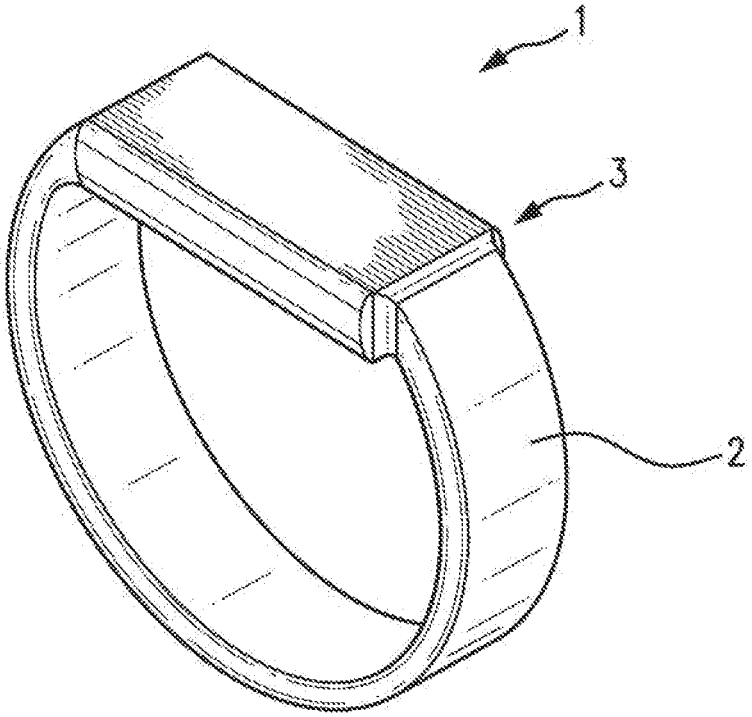
FIG. 1 is a view in perspective of one device of this invention which is a bracelet.
Figure 2:
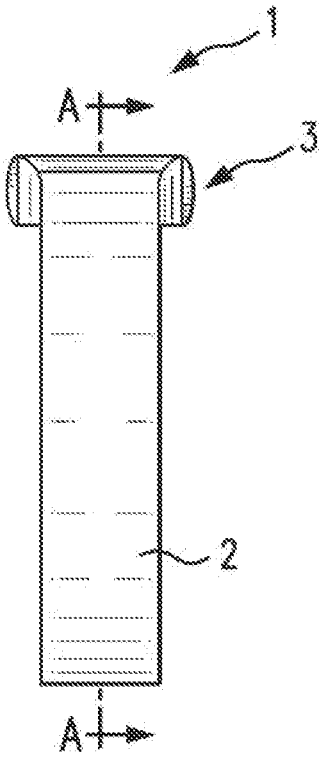
FIG. 2 is a full end view of the device of FIG. 1.
Figure 3A:
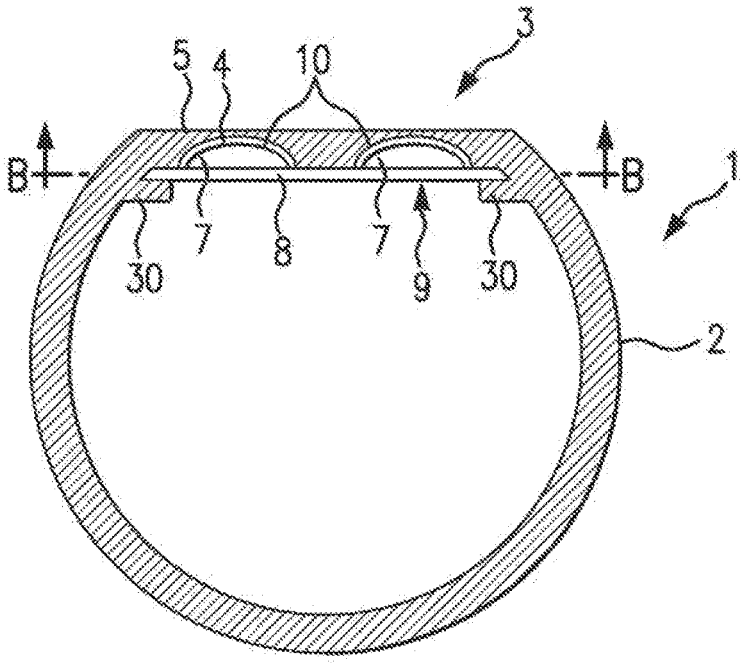
FIG. 3A is a cross-sectional view of the device of FIG. 2 through line A-A.
Figure 3B:
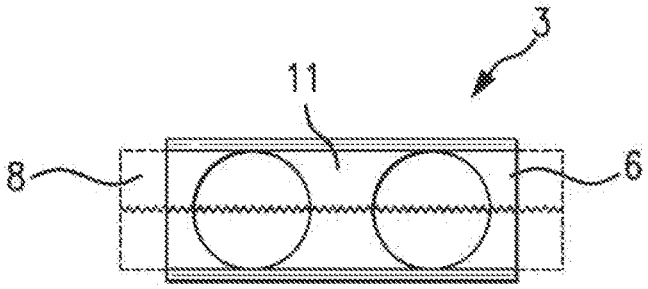
FIG. 3B is a cross-sectional view of the device of FIG. 3A through line B-B.

Turning now to FIGS. 1 to 3, one device of this invention, which is a (device of this invention) bracelet 1. Shown in these Figures are the support band 2. There is a medicament container 3. The support band 2 has the medicament container 3 supported on it. The medicament container 3 is comprised of a hollow medicament retainer 4 that has a top 5 and an open bottom 6 and the hollow in the hollow medicament retainer 4 contains a blister pack 8 having a bottom 9. The blister pack 8 contains at least one solid medicament 7 and the blister pack bottom 9 has a breakable seal 11 such that when the seal 11 is broken, the solid medicament 7 contained therein is dispensed.

Although it is not critical, the medicament contain 3 car be manufactured from such materials as elastomer, especially stretchable elastomer, wood, paper, cardboard, plastic, cloth, and the like. In some types, it is intended to be waterproof. The medicament container 3 can be manufactured such that it is disposable after one use, that is, after all the medicament is used. The medicament container may be manufactured from a material that glows in the dark.

Figure 4:
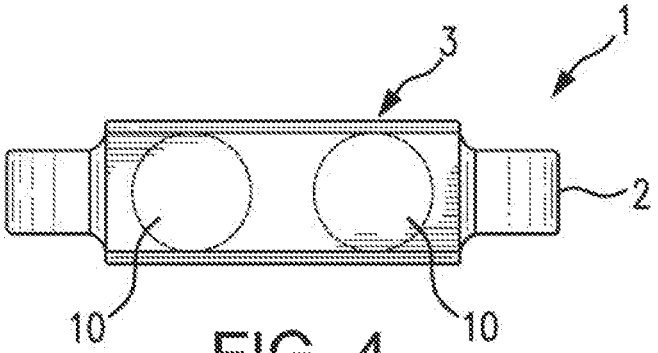
FIG. 4 is a full top view of the device of FIG. 1.
Figure 5:
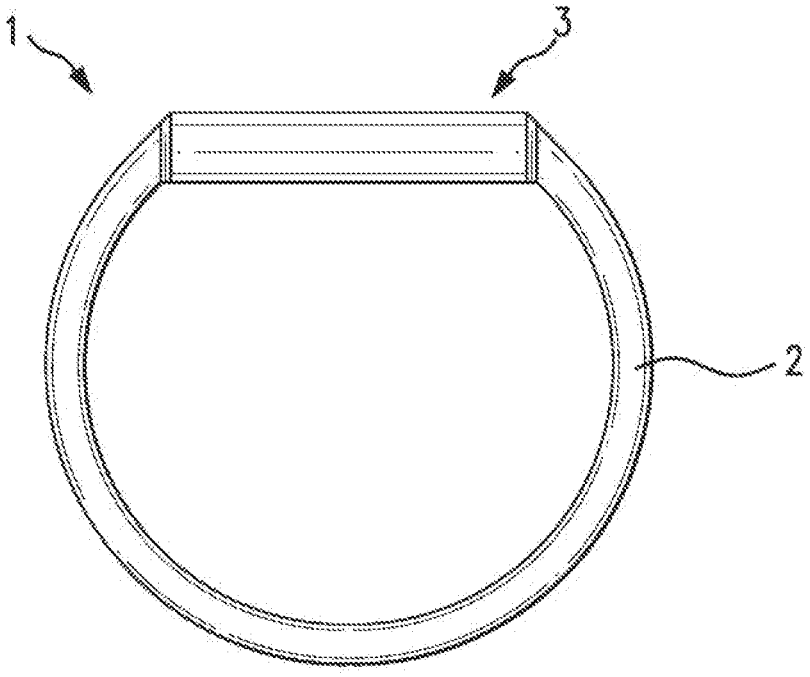
FIG. 5 is a full side view of the device of FIG. 1.

As shown, the device 1 in FIGS. 3A and 4 illustrate two spaces 10 for medicament, although, it is within the scope of this invention to have at least one space 10 and up to several spaces 10, depending on the size of the device 1 and the size of the medicament intended to be used therein.

Figure 21:
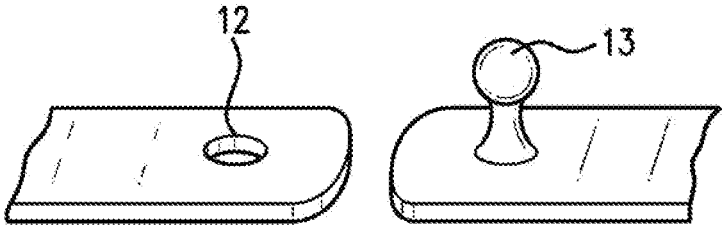
FIG. 21 is a securing device composed of an opening and a rounded peg.

Although the medicament container 3 does not necessary need a fastener to hold the support band 2 together, it is contemplated within the scope of this invention to use such fasteners. For example, one can use stretchable elastomer without any fastener whatsoever. Or, one can use stretchable elastomer wherein the support band is two-piece, and one end of the two-piece has an opening 12 in it that will fit over a peg 13 in the end of the other part of the two-piece, as illustrated in FIG. 21.

Figure 6:
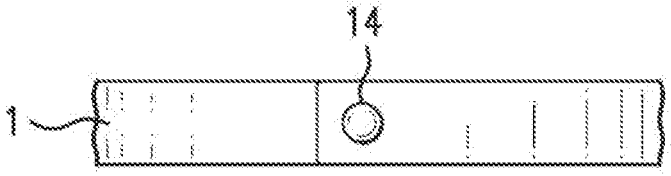
FIG. 6 is a device of this invention which is secured by a snap button.
Figure 7:
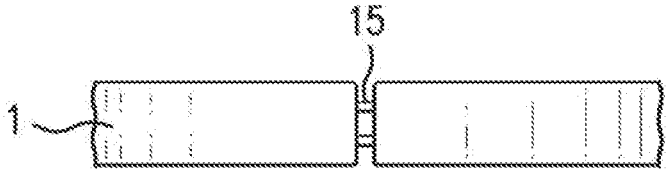
FIG. 7 is a device of this invention which is secured by snap
Figure 8:
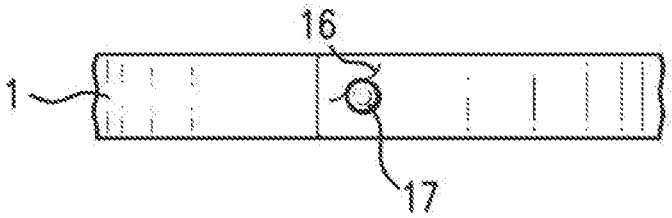
FIG. 8 is a device of this invention which is secured by string.
Figure 9:
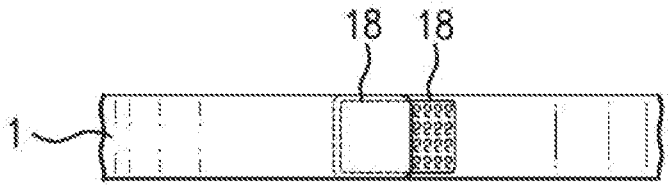
FIG. 9 is a device of this invention which is secured by a hook and loop fastener.

Further, the fastener can be a snap button 14 as illustrated in FIG. 6, a snap lock 15 as illustrated in FIG. 7, a string 16 and peg 17 as illustrated in FIG. 8, a hook and loop 18 arrangement as illustrated in FIG. 9.

Figure 10:
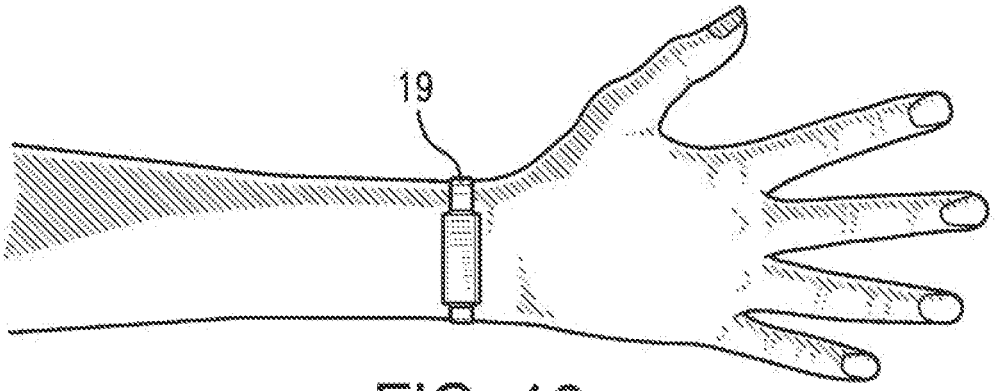
FIG. 10 is a schematic of a device of this invention on a wrist.
Figure 11:
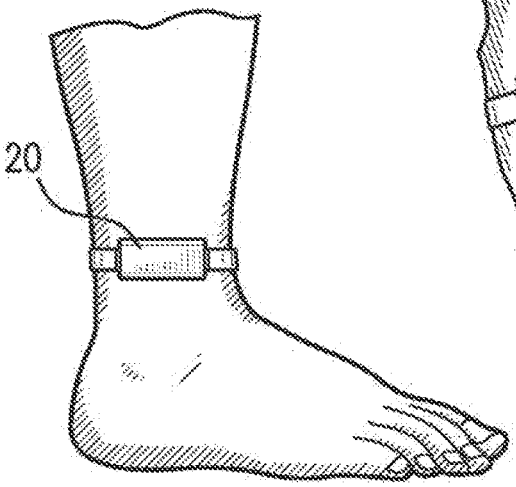
FIG. 11 is a schematic of a device of this invention on an ankle.
Figure 12:
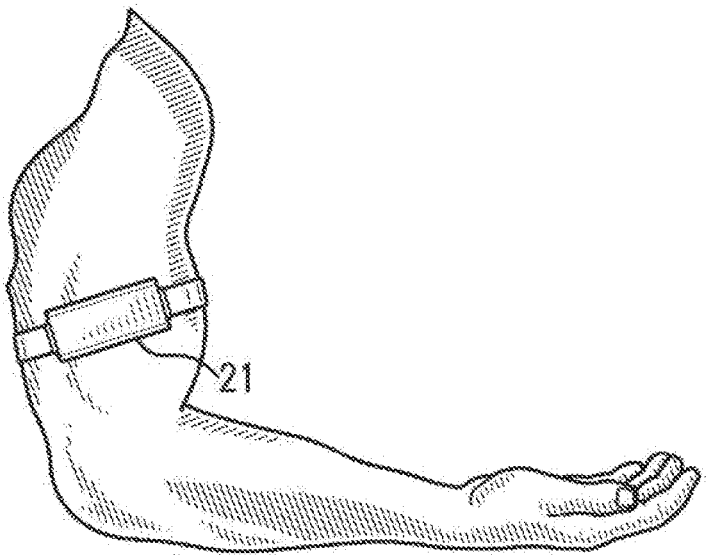
FIG. 12 is a schematic of a device of this invention on an arm.
Figure 13:
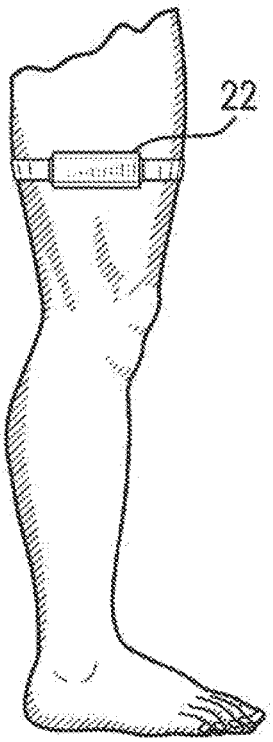
FIG. 13 is a schematic of a device of this invention on a leg.
Figure 14:
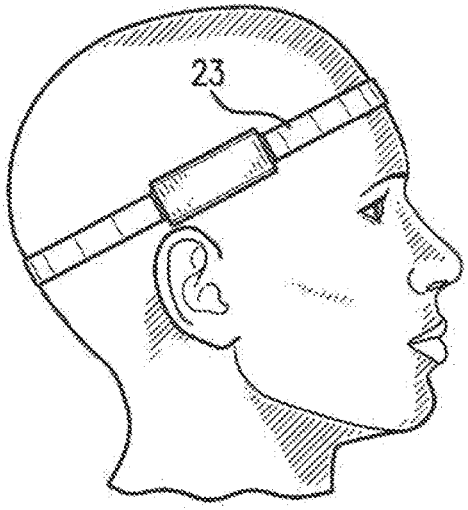
FIG. 14 is a schematic of a device of this invention as a head band.
Figure 15:
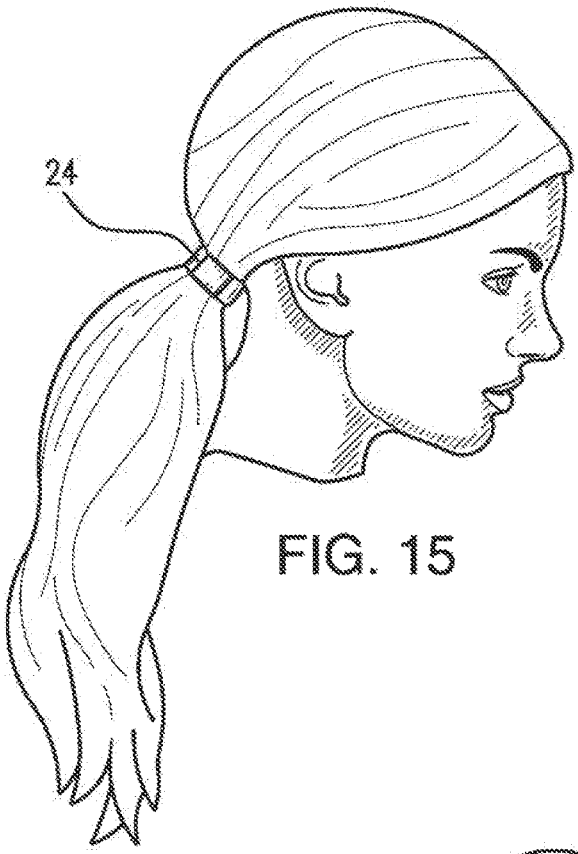
FIG. 15 is a schematic of a device of this invention as a hair tie.
Figure 16:
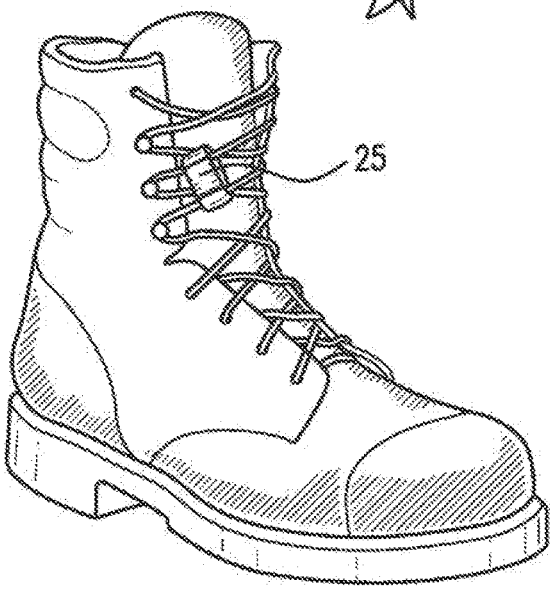
FIG. 16 is a schematic of a device of this invention secured with a shoe lace.
Figure 17:
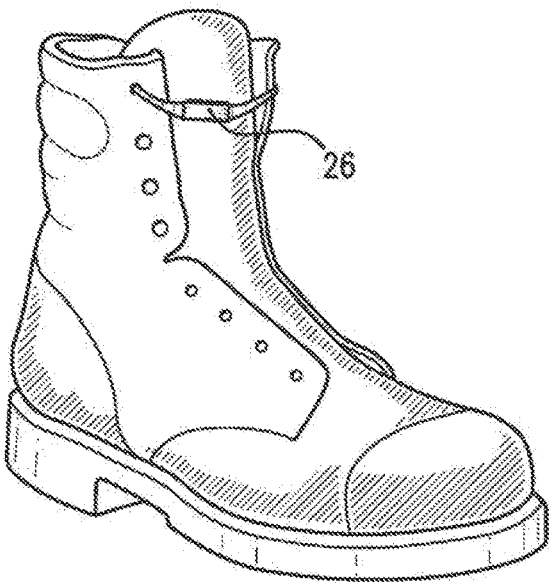
FIG. 17 is a schematic of a device of this invention adaptable to a shoe lace.
Figure 18:
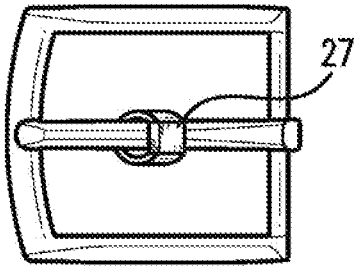
FIG. 18 is a schematic of a device of this invention on a belt buckle.
Figure 19:
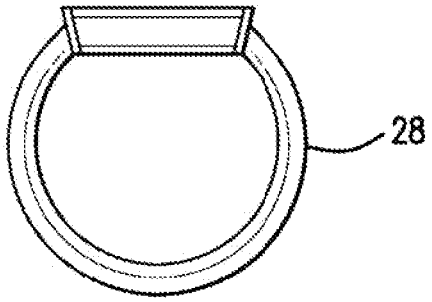
FIG. 19 is a schematic of a device of this invention as a ring.
Figure 20:
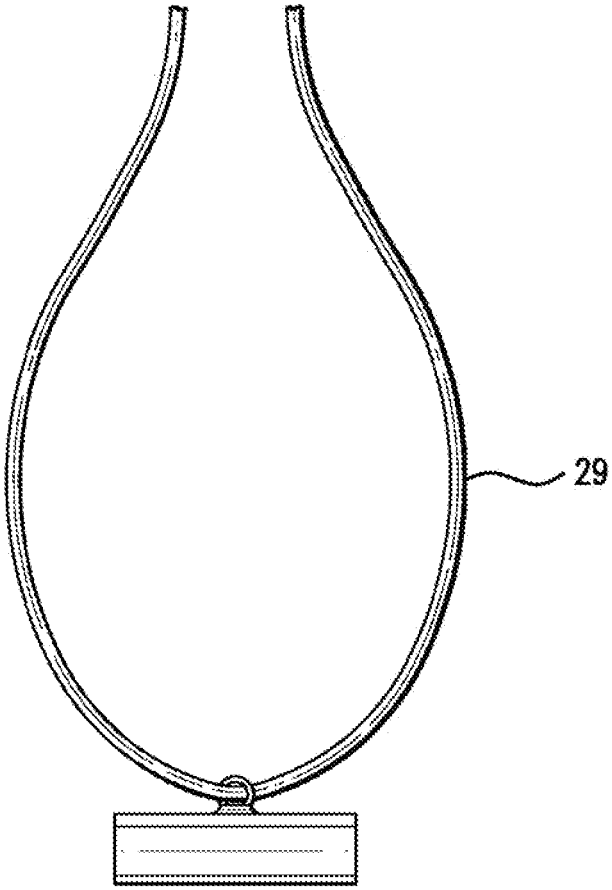
FIG. 20 is a schematic of a device of this invention as a necklace.

Although the device 1 is configured as a wrist band 19 as illustrated in FIG. 10, it can also be configured as an ankle band 20 as illustrated in FIG. 11, an arm band 21 as illustrated in FIG. 12, a leg band 22 as illustrated in FIG. 13, a head band 23 as illustrated in FIG. 14, a hair tie 24 as illustrated in FIG. 15, attached to a shoelace 25 as illustrated in FIG. 16, as a shoelace 26 as illustrated in FIG. 17, attached to a belt buckle 27 as illustrated in FIG. 18, a finger ring 28 as illustrated in FIG. 19, and a necklace 29 as illustrated in FIG. 20, to name a few uses contemplated herein.

The novel features of the devices of this invention are disposability (i.e., single use), inexpensive, pre-loaded, sealed, condition specific, wearable device such that it can be carried virtually anywhere that the user goes. The medicament container may be worn on the human wrist, human ankle, human arm, a human digit or human leg.

Another novel feature is the blister pack 8 of this device, in which the breakable seal 11 for the blister pack 8 is on the bottom of the device 1, and therefore, no cap or lid is needed on the device and access to the medicament is quick and easy.

Figure 3C:
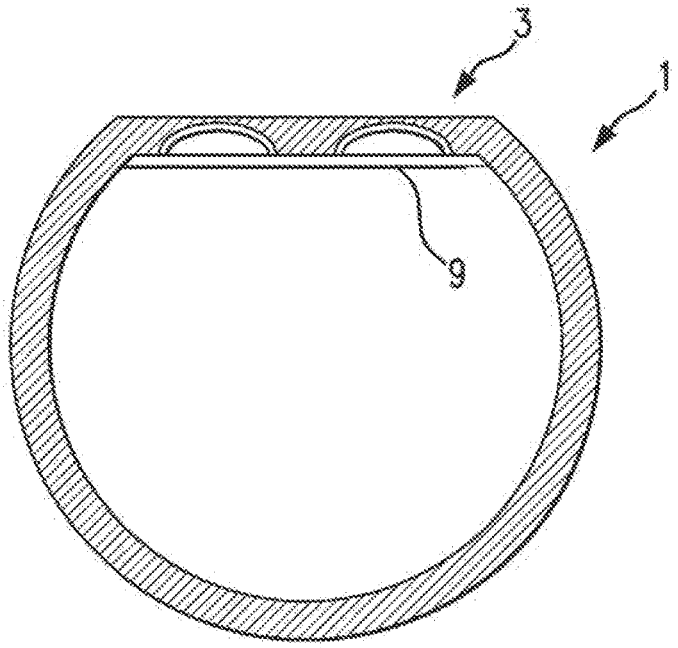
FIG. 3C is a cross-sectional view as shown in FIG. 3A, except that the elastomer projections are not shown.

Another novel feature is that the blister pack 8 can be held in place virtually by friction of the blister pack 8 against the medicament retainer walls as illustrated in FIG. 3C. Note that in this Figure, the elastomer projections 30 as shown in FIG. 3A are missing in order to allow the frictional fit of the blister pack 8.

An additional feature, of the band is that it serves a function as a medical alert band to alert people to the wearer's medical condition. The band also may include cars directions for heart attack care, for example. The two most important instructions on the band are to call emergency personal and for instructions on how and what to medicate.

What is claimed is:

1. A medicament container comprising in combination, a support band and a hollow medicament retainer, said hollow medicament retainer being supported on said support band said hollow medicament retainer having a top and an open bottom and said hollow in said hollow medicament retainer containing a blister pack having a bottom, said blister pack being supported in the hollow medicament retainer by elastomer projections said blister pack containing at least one solid medicament and said blister pack bottom having a breakable seal such that when the seal is broken, the solid medicament contained therein is dispensed wherein said medicament container is for single use.

2. The medicament container as claimed in claim 1 wherein said medicament container is waterproof.

3. The medicament container as claimed in claim 1 wherein said hollow medicament retainer is large enough to hold at least one solid medicament.

4. The medicament container as claimed in claim 1 wherein said medicament container is manufactured from stretchable elastomer.

5. The medicament container as claimed in claim 1 wherein said support band is manufactured from stretchable elastomer.

6. The medicament container as claimed in claim 1 wherein said support band is held together using a snap button.

7. The medicament container as claimed in claim 1 wherein said support band is held together using a snap lock.

8. The medicament container as claimed in claim 1 wherein said support band is held together using a string.

9. The medicament container as claimed in claim 1 wherein said support band is held together using a hook and loop fastener.

10. The medicament container as claimed in claim 1 wherein said medicament container is configured for a human wrist.

11. The medicament container as claimed in claim 1 wherein said medicament container is configured for a human ankle.

12. The medicament container as claimed in claim 1 wherein said medicament container is configured for a human arm.

13. The medicament container as claimed in claim 1 wherein said medicament container is configured for a human leg.

14. The medicament container as claimed in claim 1 wherein said medicament container is configured for a human head band.

15. The medicament container as claimed in claim 1 wherein said medicament container is configured for a human hair tie.

16. The medicament container as claimed in claim 1 wherein said medicament container is configured as a shoelace.

17. The medicament container as claimed in claim 1 wherein said medicament container is configured to be adaptable to a shoe lace.

18. The medicament container as claimed in claim 1 wherein said medicament container is configured to be adaptable to a belt buckle.

19. The medicament container as claimed in claim 1 wherein said medicament container is a ring worn on a human digit.

20. The medicament container as claimed in claim 1 wherein said medicament container is a necklace.

21. The medicament container as claimed in claim 1 wherein said medicament container includes, in addition, medical alert information.

22. The medicament container as claimed in claim 1 wherein said medicament container contains, in addition medical care instructions.

23. The medicament container as claimed in claim 1 wherein said medicament container is manufactured from material that glows in the dark.

* * * * *